US005871791A

United States Patent [19]

Noble et al.

[11] Patent Number: 5,871,791

[45] Date of Patent: Feb. 16, 1999

[54] PACKAGING CONTAINING AN ALCOHOLIC OR NONALCOHOLIC AQUEOUS BEVERAGE BASED ON ANETHOLE

[75] Inventors: Philippe Noble, Creteil; Patrice Robichon, Chatou, both of France

[73] Assignee: Pernod Ricard, Paris, France

[21] Appl. No.: 700,972

[22] Filed: Aug. 21, 1996

[30] Foreign Application Priority Data

Aug. 21, 1995 [FR] France ..... 95 09951

[51] Int. Cl.[6] ..... A21D 10/02; B65D 85/00; B65B 55/00

[52] U.S. Cl. ..... 426/127; 426/126; 426/106; 426/112; 426/131; 426/415

[58] Field of Search ..... 426/106, 131, 426/112, 126, 127, 115, 415; 428/36.6, 36.7, 412, 476.3, 480

[56] References Cited

U.S. PATENT DOCUMENTS 4,999,299 3/1991 Moritani et al. ..... 428/36.6

OTHER PUBLICATIONS

Mitsui Petrochem Ind Co. Ltd.: Derwent 92–319511 WPIDS: JP 04223134: Abstract, Aug. 1992.

*Primary Examiner*—Lynette F. Smith
*Assistant Examiner*—Brett Nelson
*Attorney, Agent, or Firm*—McDermott, Will & Emery

[57] ABSTRACT

The invention relates to a packaging made up of at least one inner, containing an alcoholic or nonalcoholic beverage based on anethole, in which the inner foil of said packaging is made up of a film of polyamide including aromatic units.

The packaging is preferably intended to contain weakly alcoholic beverages and the polyamide results from the polycondensation of meta-xylylenediamine with adipic acid.

19 Claims, 1 Drawing Sheet

PACKAGING CONTAINING AN ALCOHOLIC OR NONALCOHOLIC AQUEOUS BEVERAGE BASED ON ANETHOLE

BACKGROUND OF THE INVENTION

The present invention relates to a new packaging containing an alcoholic or nonalcoholic aqueous beverage based on anethole.

It also relates to a process intended to limit the loss of anethole present in an optionally alcoholic solution in contact with the wall of a packaging made of polymer material and to the use of a polymer film for the production of a packaging in contact with optionally alcoholic anethole solutions in order to limit the loss of anethole in contact with the wall of the packaging.

Aniseed-flavored beverages contain anethole or para-propenylmethoxybenzene, predominantly in trans form (higher than 96–97%). Anethole has the special property of being very poorly soluble in water (<50 mg/l) and soluble in alcohol. In the presence of water anethole becomes cloudy, whereas in a water/alcohol solution of high alcohol content (of the order of 45% by volume) anethole remains in the dissolved state.

In the case of alcohol-free or weakly alcoholic beverages (4–9 vol %) an emulsifier is resorted to because anethole is no longer soluble.

When aniseed-favored beverages are stored, considerable degradation appears in the course of time, especially under the effect of:

light (cis-trans isomerization), oxidation in the presence of light, interaction between anethole and the packaging material.

While it has been possible to overcome the abovementioned first two disadvantages with the aid of packages which are opaque to the ultraviolet and which act as a barrier to gases, this is not so with regard to the third point relating to the loss of anethole in contact with the packaging material.

In fact, in the case of the conventionally employed packaging made of polymer (polyethylene, polypropylene, polyvinyl chloride, polyethylene terephthalate) a very large loss of flavor (up to 100%) is observed in the course of time in contact with the polymer walls, and this prevents aniseed-flavored beverages from being marketed in plastic packaging.

This problem is still more sensitive in the case of alcohol-free or weakly alcoholic beverages based on anethole, in the case of which the loss in contact with polymer is still more rapid.

A number of scientific observations illustrate the particular behavior of this compound:

Anethole has a low coefficient of solubility in water but a high coefficient of solubility in polymers. This phenomenon is all the more important in the case of beverages containing little or no alcohol. This induces a considerable electrostatic interaction with the surface of the polymer and the adsorption of anethole onto the latter.

Furthermore, the affinity of anethole for polymers is such that an absorption phenomenon takes place, due to insertion of this compound between the polymer chains. It therefore involves a dynamic adsorption/absorption phenomenon.

In addition, anethole exhibits a high tendency to polymerize to polyanethole. This polymerization of a cationic type is promoted by the highly nucleophilic nature of the methoxy group. This phenomenon takes place especially in the case of polymers derived from styrene, maleic anhydride or acrylonitrile, which are commonly employed as packaging for beverages. This is due to the fact that anethole reacts with the molecular chains of these polymers.

However, anethole can also react with the residual monomers, given the well-known reaction of copolymerization with styrene (T. Higashimura et al., Journal of Polymer Science: part A.1, vol. 10, 85–93 (1972)) or the terpolymerization with maleic anhydride and acrylic monomers such as acrylonitrile (T. Kobuko et al., Macromolecules, vol. 3, No. 5, September–October 1970, 518–523).

For all these reasons, at the present time no plastic packaging for anethole-based beverages is known.

A bottle made of a crushable aromatic polyamide has indeed been described in the Derwent abstract AN-92319511(39), but this document merely indicates that the bottle may contain beer, sparkling beverages or juices. This bottle is furthermore taken to be similar to PET bottles which, as is known, are unusable in the case of anethole-based beverages.

This is why at the present time aniseed-flavored beverages are packaged in glass bottles.

It is therefore desirable to propose new packaging made of polymer material enabling the inertness performance of glass to be attained or approached.

SUMMARY OF THE INVENTION

After systematic research, the Applicant Company has developed a new packaging intended to contain optionally alcoholic aniseed-flavored beverages, which exhibits satisfactory characteristics, especially insofar as the absence of sorption of anethole is concerned.

This is why the subject of the invention is firstly a packaging for an optionally alcoholic beverage including anethole, in which the inner layer of the said packaging is made up of a polyamide film including aromatic units.

DETAILED DESCRIPTION

Figure 1:
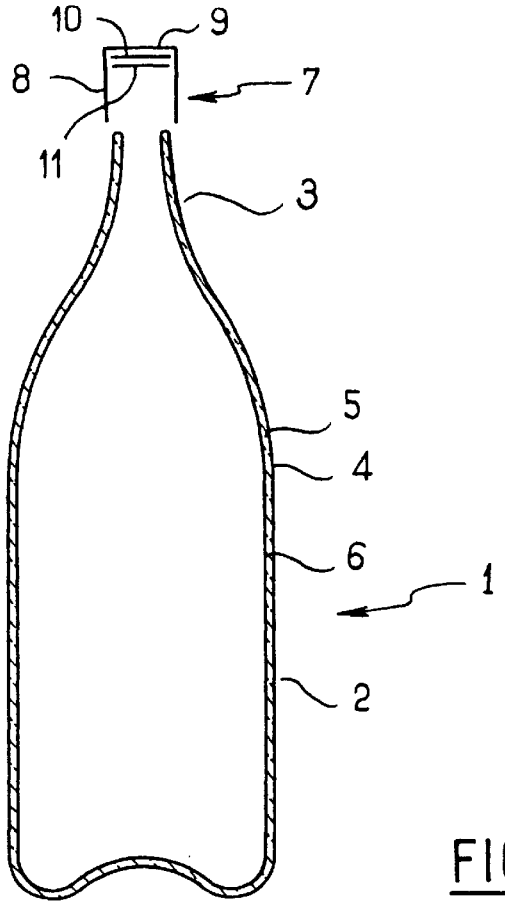

"Packaging" will be understood as any single-layer or multilayer package capable of containing said beverage, be it in the form of a bottle, can or other equivalent closed systems, including wineskins and pouches.

The packaging has been found to be particularly advantageous in the case of nonalcoholic or weakly alcoholic beverages whose alcohol content is preferably lower than 10% by volume, preferably between 3 and 9%.

In a known manner, the alcoholic aqueous beverage includes from 0.01 to 2 g/l of anethole, preferably 0.02 g/l or more of anethole.

In the concentrates to be diluted, such as the beverage known under the name "pastis" the anethole concentration is of the order of 2 g/l. In alcoholic beverages which are ready to drink it is of the order of 200 to 400 mg/l. In the case of aniseed-flavored beverages it is of the order of 10 to 50 mg/l.

It will be recalled that in the case of the alcoholic beverages of 45% strength by volume the anethole is entirely dissolved, whereas in the case of the alcohol-free or weakly alcoholic beverages (4–9% by volume) an emulsifier is resorted to in order to keep the anethole in the form of stable emulsion.

The polyamide film is preferably such that the water absorption measured according to ASTM D570 is lower than 8% and the water uptake, measured according to ASTM D570, is lower than 5%. The polyamide film is preferably such that the oxygen permeability (cc 20 m/m$^2$ day atm) at 20° C. and at 0% RH is lower than 4.

These polyamide polymers are obtained by polycondensation of a dialcohol with a diamine, one of the monomers being aromatic. The polyamide polymers are advantageously obtained by polycondensation of an aliphatic dialcohol with a $C_6$ (phenyl-based) aromatic diamine.

Among the polyamide polymers which are suitable in the context of the present invention it would be possible to mention advantageously those obtained by polycondensation of meta-xylylenediarnine with adipic acid, like Nylon-MXD6 marketed by the Solvay company or SELAR® PA marketed by the Du Pont de Nemours company.

These resins were already known to form a layer which is a barrier to oxygen, to carbon dioxide and to moisture, and were therefore already recommended for the packaging of various foodstuff products.

It will be noted, however, that no publication or manufacturers' commercial literature suggests the particularly remarkable properties of these resins with regard to anethole.

It will be noted, moreover, that in the 1992 publication which appeared in the Journal of Food Science, vol. 57, pages 490 to 492, the authors study the absorption of aromatic esters or aldehydes by various polymers, including nylon-6 or polyethylene terephthalate and that they have concluded that polyethylene terephthalate constitutes a film which is a remarkable "barrier" to esters and aldehydes or alcohols which are comparable to the polyamide. However, it is surprising to find that polyethylene terephthalate is not acceptable in the case of packaging for beverages containing anethole, especially in the case of weakly alcoholic beverages, whereas the polyamides according to the invention reveal remarkable properties making possible the industrial use of the packaging.

In general, besides the characteristics of a barrier to anethole, polyamide films containing aromatic units must exhibit a sufficient imperviousness to carbon dioxide. They must also exhibit a tear strength and an elasticity modulus which are sufficient for the application under consideration regardless of whether it is the actual packaging, the means for closing, or the leakproofing seal, single-layer or multilayer.

The thickness of the polyamide film is preferably between 10 and 100 micrometers, generally between 20 and 80 micrometers and advantageously of the order of 50 micrometers.

The invention relates in particular to a two-layer packaging comprising an outer structural layer and an inner foil made up of a film of polyamide including aromatic units.

The structural outer layer is intended to mean a material exhibiting a tear strength which is sufficient in the context of the use under consideration, especially polymer, metal or carton.

The outer layer will preferably exhibit a sufficient rigidity for bottle forming and will be chosen advantageously from the group consisting of polyesters such as polyethylene terephthalate (PET) or polyolefins, such as polypropylene (PP) or polyethylene (PE).

According to a preferred embodiment the coextrusion of the polyamide film is performed with the associated layer(s) in conditions of temperatures and of pressure which are well known in the art in question. The extrusion temperatures are usually between 200° and 320° C. The coextrusion operation may be followed by a biaxial orientation.

The packaging is preferably in the form of a three-layer material obtained by coextrusion, including an intermediate layer of a binder providing the cohesion between the inner layer and the outer layer.

The different thicknesses of the layers forming such a material are generally within the following intervals (in $\mu$m).

| | |
|---|---|
| Outer layer | 50 to 1000 |
| Intermediate layer | 5 to 50 |
| Inner layer (polyamide film) | 20 to 100 |

The outer layer generally has a thickness of between 200 and 600 mm but can go down to 50 mm in the case of films and can run to 1 mm or more in the case of large packages (drums etc.).

The invention also relates to a means for closing said packaging, provided with an inner foil made up of a polyamide film including aromatic units which is applied to said packaging.

All the alternative forms shown above relating to the packaging apply to said means for closing.

In particular, the means for closing is a multilayer material in which the outer layer is chosen from the group consisting of polyesters such as polyethylene terephthalate (PET) or polyolefins such as polypropylene (PP) or polyethylene (PE).

This means for closing is in particular a cylindrical cap inside which an inner foil as defined above is housed.

The following applications may be mentioned among the many items of packaging according to the invention which can be produced:

multilayer plastic bottles of the PP/B/PA and PET/B/PA type.

Such a bottle has been shown in the appended FIG. 1. This figure is a view in lengthwise section in which the bottle 1 made up of a cylindrical body 2 and of a neck 3 consists of an outer layer 4 of polyethyleneterephthalate, a layer of intermediate binder 5 and an inner layer 6 of polyamide containing aromatic units.

The cap 7 is made up of a cylindrical body 8 and of a cylindrical base 9. Inside the cap 7 is housed a disk made up of a layer of PET 10 applied to the interior face of the base and a layer of aromatic polyamide 11 bearing on the neck 3.

It is also possible to produce carton packaging in which the inner face is coated with a polyamide film containing aromatic units, such as cartons, as well as metal cans comprising such a coating or closure articles (caps, lids) etc.

The invention also relates to the use of a polyamide including aromatic units for the production of packaging intended to come into contact with solutions of anethole, especially weakly alcoholic ones, in order to limit the loss of anethole in contact with the wall of the packaging.

It also relates to a process intended to limit the loss of anethole present in alcoholic or nonalcoholic solutions, especially weakly alcoholic ones, in contact with the wall of the packaging made of polymer material, in which the wall made of polymer material in contact with the anethole solution is a polyamide including aromatic units.

The invention also relates to a process for producing a packaging containing an alcoholic or nonalcoholic beverage including anethole, in which a packaging such as that described above is filled with said beverage, and is subsequently closed up.

The invention is now illustrated by the following examples, given by way of illustration.

EXAMPLE 1

Bottles consisting of an outer layer of polypropylene and of an inner foil of a film of polyamide of SELAR PA® brand are formed by coextrusion with an adhesion binder. The inner foil has a mean thickness of 50 micrometers, the outer layer has a mean thickness of 520 micrometers and the intermediate layer a mean thickness of 44 micrometers.

The bottles are all heat-sealed with a PE/ALU/PE closure and are filled cold, in the presence of a bacteriostat, with a nonalcoholic aniseed-flavored solution containing 235 mg/l of anethole, and are then left for 12 months at 20° C.

The loss of anethole is evaluated at regular intervals:

It is found that after 6 months the loss of anethole is 12.7% and that after a year it is 14%. A plateau is therefore observed starting at six months, the loss of anethole having changed little since this time.

EXAMPLE 2

Bottles consisting of an outer layer of polypropylene and of an inner foil of a film of polyamide of Selar PA® brand are formed by coextrusion with an adhesion binder. The inner foil has a mean thickness of 50 micrometers, the outer layer has a mean thickness of 520 micrometers and the intermediate layer a mean thickness of 44 micrometers.

The bottles are all heat-sealed with a PE/ALUI/PE closure and are filled cold, in the presence of a bacteriostat, with an aniseed-flavored solution containing:

235 mg/l of anethole,

6% of alcohol by volume, and are then left for 12 months at 20° C.

The loss of anethole is evaluated at regular intervals:

It is found that after 6 months the loss of anethole is 11.8% and that after a year it is 13%. A plateau is therefore observed starting at six months, the loss of anethole having changed little since this time.

EXAMPLE 3

Another test was carried out with identical bottles filled with an aniseed-flavored beverage containing 2 g/l of anethole and 45% v/v of alcohol.

The bottles are left for 12 months at 20° C.

The loss of anethole is evaluated at regular intervals:

It is found that after 6 months the loss of anethole is 5% and that after a year it is 6%. A plateau is therefore observed starting at six months, the loss of anethole having changed little since this time.

EXAMPLE 4 (COMPARATIVE)

Bottles formed from polyethylene terephthalate, marketed by the company Cusenier (France) for fruit syrups (Sironimo®) are filled with the same solutions as in Examples 1 and 2 and are left for 12 months at 20° C.

The loss of anethole is evaluated at regular intervals. It is found that after 6 months the loss is of the order of 90% and, after 12 months, 100%.

EXAMPLE 5 (COMPARATIVE)

An example similar to Example 4 was performed with polyethylene bottles marketed by the company Pampryl (France) for fruit juices and with polypropylene bottles.

A loss greater than 90% after 6 months and of 100% after 12 months is found.

EXAMPLE 6 (COMPARATIVE)

An example similar to Example 4 with a PVC bottle is carried out.

A loss greater than 90% after 6 months and of 100% after 12 months is found.

EXAMPLE 7 (COMPARATIVE)

A test similar to Example 4 is carried out with a glass bottle. A loss of approximately 3% after 6 months and of approximately 6% after 12 months is found.

Figure 2:
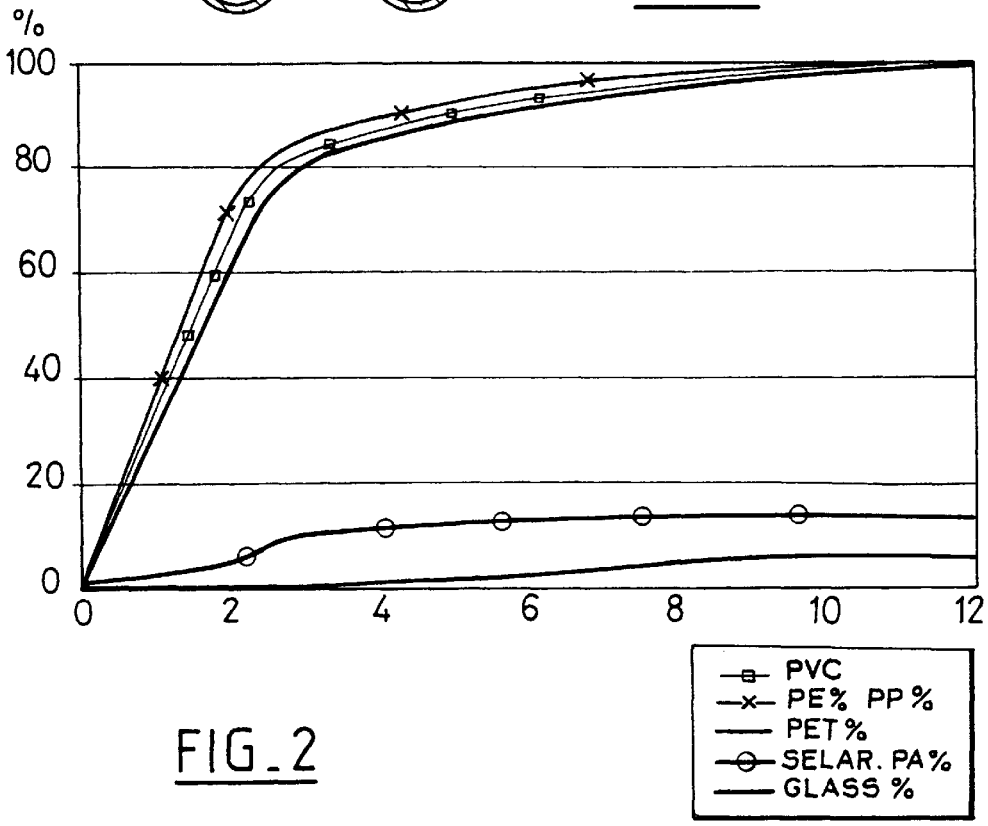

The diagram in FIG. 2 summarizes the results obtained as a percentage loss of anethole as a function of the number of months in tests 1, 4, 5, 6 and 7.

From these experiments it is concluded: while it was well known that the polymers containing aromatic units such as PET or polystyrene were not suitable for the reasons set out in the description of the invention and while the same applied to the polyolefins, the particular combination of aromatic units and of amide groups results in a drastic decrease in the loss of anethole.

We claim:

1. An anethole packaging comprising an inner film consisting essentially of an aromatic polyamide wherein said inner film is in contact with a liquid containing anethole thereby reducing the degradation or loss of anethole in said packaging.

2. The packaging as claimed in claim 1, wherein the polyamide film is such that the water absorption, measured according to ASTM D570, is lower than 8% and the water uptake, measured according to ASTM D570, is lower than 5%.

3. The packaging as claimed in claim 1, wherein the polyamide film is such that the oxygen permeability (cc 20 $m/m^2$ day atm) at 20° C. and 0% RH is lower than 4.

4. The packaging as claimed in claim 1, wherein the film is a polyamide resulting from the polycondensation of meta-xylylenediamine with adipic acid.

5. The packaging as claimed in claim 1, wherein the liquid is nonalcoholic or has an alcohol content less than 10% by volume.

6. The packaging as claimed in claim 5, wherein the liquid includes up to 10% by volume of alcohol.

7. The packaging as claimed in claim 6, wherein the liquid includes 3 to 9% by volume of alcohol.

8. The packaging as claimed in claim 1, wherein the liquid includes 0.002 to 2 g/l of anethole.

9. The packaging as claimed in claim 8, wherein the liquid includes 0.01 to 2 g/l of anethole.

10. The packaging as claimed in claim 2, wherein the film has a thickness of between 10 and 100 micrometers.

11. The packaging as claimed in claim 10, wherein the film has a thickness of between 20 and 80 micrometers.

12. The packaging as claimed in claim 1, further comprising a structural outer layer.

13. The packaging as claimed in claim 12, wherein the outer layer is made up of a polymer.

14. The packaging as claimed in claim 13, wherein the outer layer is chosen from the group consisting of polyesters and polyolefins.

15. The packaging as claimed in claim 14, wherein the outer layer is chosen from the group consisting of polyethylene terephthalate, polypropylene and polyethylene.

16. The packaging as claimed in claim 12, wherein the outer layer is made of metal.

17. The packaging as claimed in claim 12, wherein the outer layer is made of cardboard.

18. The packaging as claimed in claim 12, further comprising an intermediate binding layer between an inner and outer layer.

19. The packaging as claimed in claim 12, which is in the form of a bottle.

* * * * *